US006904957B1

(12) United States Patent
Degtiarenko

(10) Patent No.: US 6,904,957 B1
(45) Date of Patent: Jun. 14, 2005

(54) COOLED PARTICLE ACCELERATOR TARGET

(75) Inventor: Pavel V. Degtiarenko, Williamsburg, VA (US)

(73) Assignee: Southeastern Univ. Research Assn., Newport News, VA (US)

( * ) Notice: Subject to any disclaimer, the term of this patent is extended or adjusted under 35 U.S.C. 154(b) by 161 days.

(21) Appl. No.: 10/231,583

(22) Filed: Aug. 30, 2002

(51) Int. Cl.[7] ..... F28F 7/00
(52) U.S. Cl. ..... 165/47; 165/80.1; 378/141
(58) Field of Search ..... 165/47, 80.1; 378/141

(56) References Cited

U.S. PATENT DOCUMENTS 4,309,637 A * 1/1982 Fetter ..... 378/140
4,916,015 A * 4/1990 Schaffner et al. ..... 378/141
4,943,989 A * 7/1990 Lounsberry et al. ..... 378/141
6,115,454 A * 9/2000 Andrews et al. ..... 378/140
6,519,317 B2 * 2/2003 Richardson et al. ..... 378/141

* cited by examiner

*Primary Examiner*—Ljiljana Ciric

(57) ABSTRACT

A novel particle beam target comprising: a rotating target disc mounted on a retainer and thermally coupled to a first array of spaced-apart parallel plate fins that extend radially inwardly from the retainer and mesh without physical contact with a second array of spaced-apart parallel plate fins that extend radially outwardly from and are thermally coupled to a cooling mechanism capable of removing heat from said second array of spaced-apart fins and located within the first array of spaced-apart parallel fins. Radiant thermal exchange between the two arrays of parallel plate fins provides removal of heat from the rotating disc. A method of cooling the rotating target is also described.

9 Claims, 2 Drawing Sheets

COOLED PARTICLE ACCELERATOR TARGET

The United States of America may have certain rights to this invention under Management and Operating contract No. DE-AC05-84ER 40150 from the Department of Energy.

FIELD OF THE INVENTION

The present invention relates to particle accelerator target arrangements and more particularly to a method and apparatus for cooling these and similar such targets, e.g. laser targets, that obviates the need for rastering of the incoming beam to obtain adequate target cooling.

BACKGROUND OF THE INVENTION

The need to generate uniform or homogeneous patterns of electron beams directed at suitable targets in order to minimize localized heating and concomitant target damage is well known to those skilled in the art of particle accelerator, laser processing and the like operations. Such requirements also exist in such industrial applications as ion implantation and in medical therapy using charged particle beams. Commonly, sinusoidal or rotating beam raster systems are used to produce beam patterns that constantly vary the area of the target that is impacted by the beam with the objective of avoiding localized heating of the target material.

Beam rastering in a common practice for dealing with high local power deposition in accelerator and the like apparatus that involve beam interaction with a target. However, the rastering technique is limited because it is not always possible to increase the area covered by the rastered beam at the target face fast enough to be able to dissipate all of the generated heat. Also, large beam rastering can be a source of systematic errors in many experiments and cause elevated experimental and environmental radiation background, especially in experiments involving electron beams.

Another common practice in such circumstances is making the target moveable, and designed large enough to be able to dissipate all of the power deposited thereon. The position of the impact area in the target changes in time in essentially the same way as occurs in the rastering method. The advantages of such a method include a much larger capability to dissipate locally deposited heat, and the option to keep the position of the beam interaction region fixed in the laboratory frame. While such target movements sometimes are adequate to solve the target overheating problem they often do not provide adequate cooling of the target between beam impacts to adequately avoid target overheating. For example, target rotation with a constant beam direction, i.e. without rastering of the particle beam, can provide adequate cooling in some circumstances where target speed can be slowed adequately. This, however, is not an ideal solution nor is it appropriate for many of the situations in which particle, laser or the like beams are applied. This is especially true in those case where beam impact is necessary for a prolonged period of time to obtain a desired experimental result.

Target cooling in such applications is further complicated by the general location of particle beam, laser or the like targets in, for example, vacuum environments that do not permit the easy use of convection or conductive cooling techniques. Such is particularly true in those cases where localized target overheating is sought to be avoided by target rotation.

Thus, there exists a need for an apparatus and method that permits adequate target movement and/or cooling during particle or the like beam impact to provide the level of target cooling necessary to obtain satisfactory target/beam interaction without overheating.

OBJECTS OF THE INVENTION

It is therefore an object of the present invention to provide a particle or the like beam target apparatus that is capable of achieving target cooling during beam impact, especially during target irradiation for extended periods of time.

It is another object of the present invention to provide a method for cooling particle or other beam targets that operate in a vacuum or the like and are rotated either to reduce target heating or to insure exposure of new target areas to the particle beam during operation.

SUMMARY OF THE INVENTION

According to the present invention, there is provided a novel beam target apparatus comprising: a rotating target disc thermally coupled to a first array of spaced-apart parallel plate fins that mesh without physical contact with a second array of spaced-apart fins that are thermally coupled to a conductor capable of removing heat from said second array of spaced-apart parallel plate fins. Thermal exchange occurs between the two arrays of meshing, spaced-apart parallel plate fins through radiation. There is also provided a method of cooling a rotating beam target through the use of the previously described apparatus.

DESCRIPTIONS OF THE DRAWING

DETAILED DESCRIPTION

The apparatus described herein is proposed for use in beam impingement applications where large power deposition in the target area is anticipated and where beam rastering is either undesirable or impossible or does not solve the overheating problem. According the apparatus described herein, the target takes the shape of a flat ring or disc of constant thickness installed around the perimeter of a suitable cylinder playing the role of a heat sink. The cylinder is mounted on two bearings and can be rotated by a drive motor around a cylindrical heat sink. Two arrays of parallel plate fins are attached to the inner diameter of the target cylinder and to the outer diameter of the heat sink cylinder and inserted between each other in non-contacting relationship. When a beam, electron, laser or the like strikes the rotating target, heat is evenly distributed around the entire target ring and heat is transferred by conduction and radiation to the heat sink.

Figure 1:
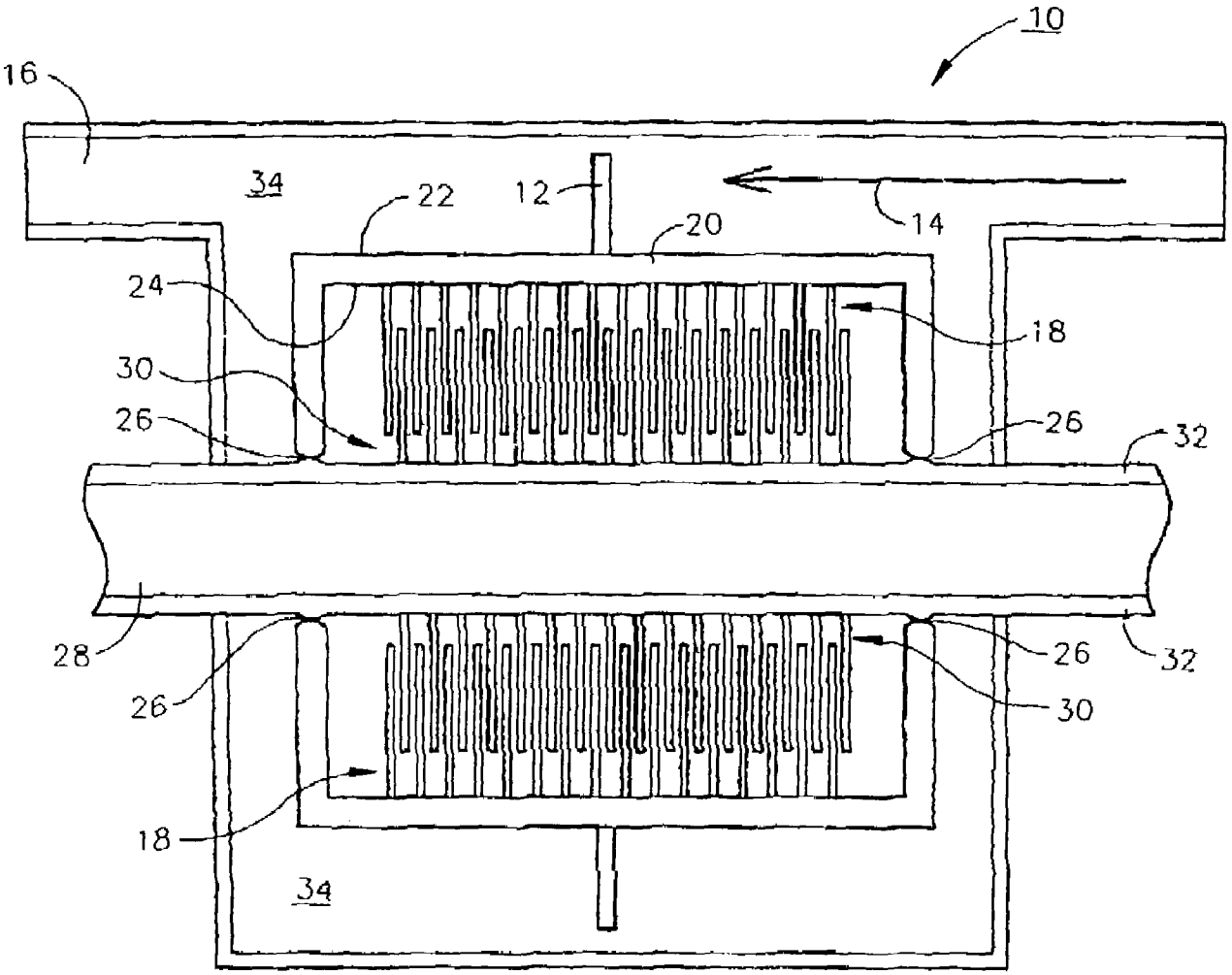
FIG. 1 is a cross-sectional view of the target apparatus of the present invention.

Referring now to FIG. 1, the novel target apparatus 10 of the present invention comprises: a rotating target disc 12, located in the path of an incoming beam 14 within a beam pipe 16. Rotating target disc 12 is thermally coupled to a first array of spaced-apart parallel plate fins 18, the hot parallel plate fins. In the embodiment depicted in FIG. 1, spaced-apart parallel plate fins 18 are conductively coupled to target disc 12 by attachment to a retainer member 20 that is attached on one surface 22 thereon to target disc 12 and at its other surface 24 to spaced-apart parallel plate fins 18. In this embodiment, bearings 26 are provided to permit retainer member 20 to rotate freely about heat exchanger or coolant conduit 28 that contains a coolant medium capable of extracting heat from the second array of spaced-apart parallel plate fins 30. Again, as depicted in FIG. 1, the second array of spaced-apart parallel plate fins 30, the cold parallel plate fins, are physically attached to coolant conduit 28 so that thermal exchange between coolant conduit 28 and second or cold spaced-apart parallel plate fins 30 is by conduction through wall 32 of coolant conduit 28. Target disc 12, retainer 20 and associated first spaced-apart parallel plate fins are rotated by a motor, not shown. As will be obvious to the skilled artisan, any number of alternative arrangements for achieving thermal conductivity between target disc 12 and first array of spaced-apart parallel plate fins 18 and coolant conduit 28 and second array of spaced-apart parallel plate fins 30 can be envisioned and any and all such alternatives are intended to be encompassed within the disclosure and claims hereof. It is the ability of the apparatus of the present invention to efficiently extract heat from a rotating target disc 12 through the use of radiational heat exchange between two proximate but not contacting arrays of "co-rotating", non-contacting parallel plate fins, 18 and 30, that provides the essence of the present invention. Such an arrangement permits the extraction of heat from target disc 12 even in a vacuum such as that in volume 34 that encompasses beam pipe 16 as well as target disc 12 and both arrays of spaced-apart parallel plate fins 18 and 30.

As will be known to the skilled artisan, radiational heat exchange from hot parallel plate fins 18 to cold parallel plate fins 30 is defined as a heat flux $H=F_{rad}S\ c\ (T^4_{hot}-T^4_{cold})$ where $F_{rad}$ is a coefficient dependent upon the parallel plate surface properties, S is radiating area; $c=5.7\ 10^{-12}$ W $cm^{-2}$ $K^{-4}$, the Stefan-Boltzman constant and T is temperature in degrees Kelvin. If $T_{cold}$ is neglected and assume for a simple exercise the equilibrium temperature of the heat sink to be 1000° K, outer radius of a coolant pipe 2 cm, the inner radius of the heat sink 10 cm and $F_{rad}$ conservatively as 0.3 the heat flux exiting one single hot fin equals approximately $0.3\times600\times5.7\times1000^4$ which is about 1 kW, if one assumes that the heat flux at this rate can be absorbed by the coolant. More detailed calculations are needed for a specific optimized design, but this simple example shows that the heat exchange capability of such a device is not at all trivial. Depending upon the target and beam required for a specific application, or class of applications, the parameters of the device such as dimensions, specific choice of materials, number and thickness of the radiating fins, etc. can be readily defined. Thus, the appropriate area and surface characteristics of any particular cooling apparatus as described herein can be readily determined and the appropriate apparatus designed for any particular application by a competent engineer given the description of the apparatus contained herein.

Operationally, heat generated by the impact of beam 14 on target 12 is transmitted by conduction through retainer 20 to first radial array of parallel plate fins 18. This heat is then transmitted by radiation to second radial array of parallel plate fins 30 and then by conduction through wall 32 to the coolant inside of coolant conduit 28 to the contained coolant where it is extracted from the system.

Figure 2:
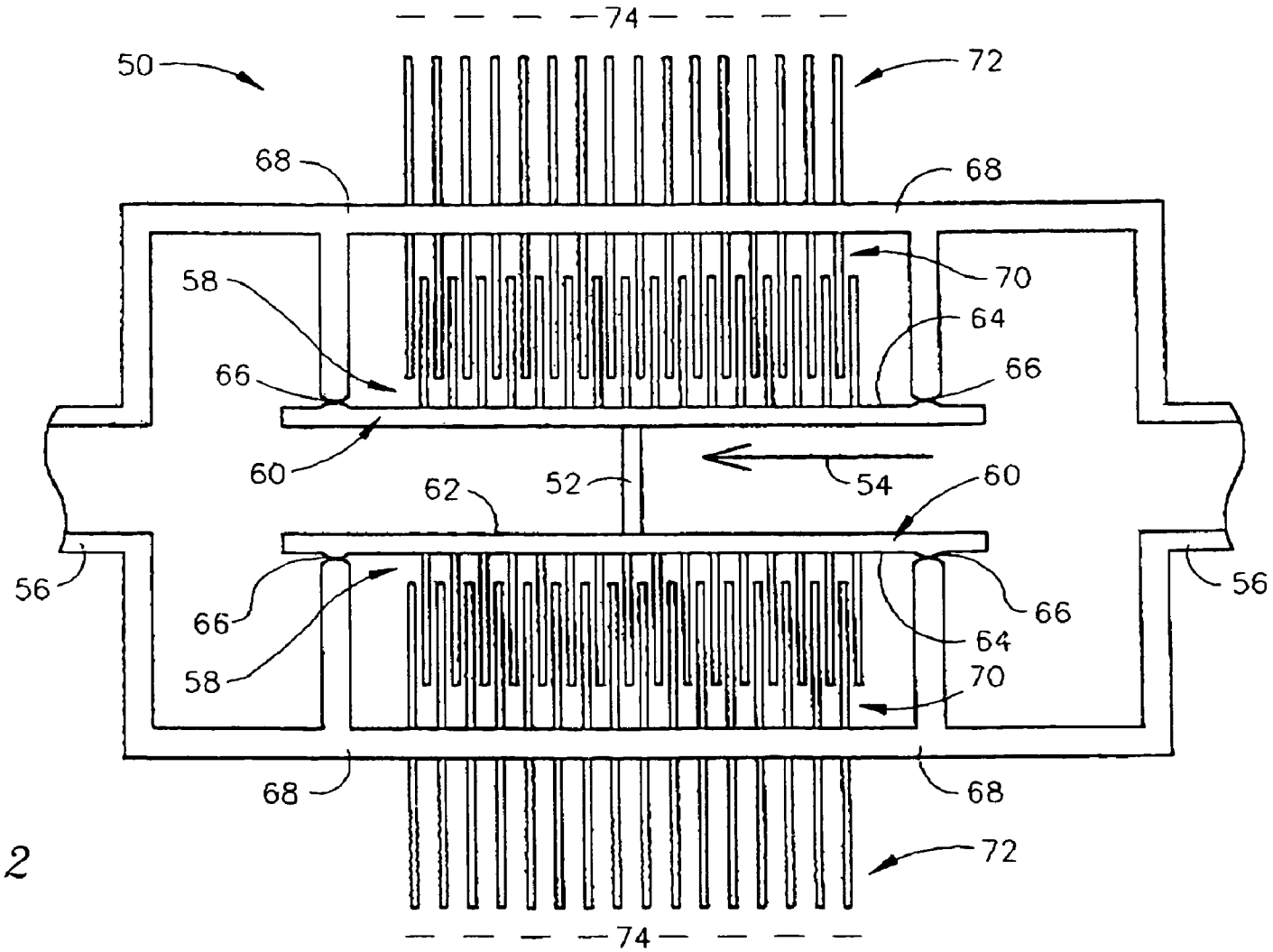
FIG. 2 is a cross-sectional view of an alternate preferred embodiment of the apparatus of the present invention.

It is further envisioned that in the proper circumstance, an apparatus wherein target disc 12 and associated retainer member 20 and first array of parallel plate spaced-apart fins 18 rotate inside of second array of parallel plate spaced-apart fins 30 and coolant conduit 28 encompasses the entire assembly 10 is contained within the envelope defined by a circumferential coolant conduit 28. Such an arrangement is depicted in FIG. 2 wherein target apparatus 50 comprises a disc shaped target 52 located in the path of an incoming beam 54 within an evacuated beam pipe 56. Rotating target disc 52 is thermally coupled to a first array of spaced-apart parallel plate fins 58, the hot parallel paltes. In the embodiment depicted in FIG. 2, spaced-apart parallel plate fins 58 are conductively coupled to target disc 52 by attachment to retainer member 60 that is in turn attached on one surface 62 thereon to target disc 52 and at its other surface 64 to spaced-apart parallel plate fins 58 disposed about the outer periphery thereof. Beam 54 impinges upon target disc 52 off center so as to permit the constant introduction of new surface area to impinging beam 54. In this embodiment, bearings 66 are provided to permit retainer member 60 to rotate freely. Target disc 52, retainer 60 and associated first parallel plate fins 58 are rotated by a motor, not shown. The second array of spaced-apart parallel plate fins 70, the cold parallel plate fins, are physically attached to conductive cold retainer 68 so that thermal exchange between the outside coolant 74 and second or cold spaced-apart parallel plate fins 70 is by conduction therethrough the walls of retainer 68. In this fashion, meshed first and second radial arrays of parallel plate fins 58 and 70 can rotate between one another. A coolant or heat extraction medium 74 circulates about the outer periphery of retainer 68. In the example depicted in FIG. 2, heat is extracted from retainer 68 by radial array of parallel plate fins 72 that extend about the outer periphery thereof. A suitable coolant, for example cooled air, liquid nitrogen etc. is circulated about third radial array of parallel plate fins 72, preferably in a direction orthogonal to the plane of FIG. 2, to extract heat emitted from third radial array of parallel plate fins 72.

As the invention has been described, it will be apparent to those skilled in the art that the same may be varied in many ways without departing from the spirit and scope of the invention. Any and all such modifications are intended to be included within the scope of the appended claims.

What is claimed is:

1. A target apparatus comprising:

A) a beam pipe;

B) a target in the form of a flat ring that intersects said beam pipe, and has an inner diameter;

C) a cylindrical retainer connected to and thermally coupled to said inner diameter and also having a retainer inner periphery;

D) a first radial array of spaced-apart parallel plate fins disposed about said retainer inner periphery and thermally coupled to said target;

E) a cooling mechanism passing through said first radial array of spaced-apart parallel plate fins said cooling mechanism including an outer periphery having a second radial array of spaced-apart parallel plate fins radially disposed about said outer periphery and thermally coupled to and meshing in non-contacting arrangement with said first radial array of spaced-apart parallel plate fins; and F) a mechanism for rotating said target and said first radial array of spaced-apart parallel plate fins with respect to said cooling mechanism and said second array of spaced-apart parallel plate fins.

2. The target apparatus of claim 1 wherein said cooling mechanism comprises a cylindrical coolant pipe for the passage of a fluid coolant therethrough and has an outer surface.

3. The target apparatus of claim 2 wherein said second radial array of parallel plate fins is arranged about said coolant pipe outer surface.

4. The target apparatus of claim 1 wherein said apparatus is contained in a vacuum environment.

5. The target apparatus of claim 1 further including a cylindrical retainer having an outer surface and an inner surface, said flat ring target being attached to said outer surface and said first radial array of parallel plate fins is attached to said inner surface, and said retainer, said flat ring target and said retainer are all capable of rotating as a unit about said cooling mechanism while said first and second radial arrays of parallel plate fins are in meshed configuration.

6. The target apparatus of claim 5 further including bearings between said retainer and said outer surface permitting said rotation.

7. A method for cooling a target exposed to a beam that causes heating of said target comprising:

i) exposing said target to said beam in an apparatus comprising;

A) a beam pipe;

B) a target in the form of a flat ring that intersects said beam pipe, and has an inner diameter;

C) a cylindrical retainer connected to and thermally coupled to said inner diameter and also having a retainer inner periphery;

D) a first radial array of spaced-apart parallel plate fins disposed about said retainer inner periphery and thermally coupled to said target;

E) a cooling mechanism passing through said first radial array of spaced-apart parallel plate fins said cooling mechanism including an outer periphery having a second radial array of spaced-apart parallel plate fins radially disposed about said outer periphery and thermally coupled to and meshing in non-contacting arrangement with said first radial array of spaced-apart parallel plate fins; and F) a mechanism for rotating said target and said first radial array of spaced-apart parallel plate fins with respect to said cooling mechanism and said second array of spaced-apart parallel plate fins; and ii) extracting heat from said target via said cooling mechanism.

8. The method of claim 7 wherein said cooling mechanism comprises a cylindrical coolant pipe for the passage of a fluid coolant therethrough and has an outer surface.

9. The method of claim 8 wherein said second radial array of parallel plate fins is arranged about said coolant pipe outer surface.

* * * * *